US011542947B2

(12) United States Patent
Funakoshi et al.

(10) Patent No.: US 11,542,947 B2
(45) Date of Patent: Jan. 3, 2023

(54) LIQUID PRESSURIZING APPARATUS AND UREA SYNTHESIS PLANT

(71) Applicant: MITSUBISHI HEAVY INDUSTRIES, LTD., Tokyo (JP)

(72) Inventors: Hiroshi Funakoshi, Tokyo (JP); Norio Mitsui, Tokyo (JP); Keiichi Meguro, Tokyo (JP); Yasushi Ueda, Tokyo (JP); Akio Maeda, Tokyo (JP); Shinji Ogino, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 994 days.

(21) Appl. No.: 16/325,815

(22) PCT Filed: Nov. 1, 2017

(86) PCT No.: PCT/JP2017/039634
§ 371 (c)(1),
(2) Date: Feb. 15, 2019

(87) PCT Pub. No.: WO2018/131268
PCT Pub. Date: Jul. 19, 2018

(65) Prior Publication Data

US 2021/0363996 A1 Nov. 25, 2021

(30) Foreign Application Priority Data

Jan. 10, 2017 (JP) ..... JP2017-002210

(51) Int. Cl.
*F04D 1/06* (2006.01)
*F04D 13/16* (2006.01)
(Continued)

(52) U.S. Cl.
CPC ..... *F04D 1/06* (2013.01); *E21B 41/0085* (2013.01); *E21B 43/126* (2013.01);
(Continued)

(58) Field of Classification Search
CPC . F04D 1/06; F04D 13/10; F04D 13/08; F04D 13/086; F04D 1/066; F04D 29/086;
(Continued)

(56) References Cited

U.S. PATENT DOCUMENTS 4,932,848 A 6/1990 Christensen
7,619,114 B2 11/2009 Pagani
(Continued)

FOREIGN PATENT DOCUMENTS

CN 101219971 A 7/2008
CN 103570588 A 2/2014
(Continued)

OTHER PUBLICATIONS

Office Action dated Mar. 17, 2021, issued in counterpart EP Application No. 17891724.1. (6 pages).
(Continued)

*Primary Examiner* — Peter J Bertheaud
(74) *Attorney, Agent, or Firm* — WHDA, LLP

(57) ABSTRACT

A liquid pressurizing apparatus, comprises a tank provided on a device installation surface for storing liquid so that a fluid level is located above the device installation surface; and a vertical pump including a suction port connected to the tank, multi-stage impellers arranged in a vertical direction, and a discharge port for discharging the liquid passing through the multi-stage impellers. The multi-stage impellers include a first stage impeller positioned at the lowest part of the multi-stage impellers and being configured such that the liquid from the suction port flows into the first stage impeller. The first stage impeller is disposed below the device installation surface.

10 Claims, 4 Drawing Sheets

(51) Int. Cl.

| | |
|---|---|
| ***F04D 29/043*** | (2006.01) |
| ***F04D 29/42*** | (2006.01) |
| ***E21B 43/12*** | (2006.01) |
| ***E21B 41/00*** | (2006.01) |
| ***F04D 29/44*** | (2006.01) |
| ***F04D 13/06*** | (2006.01) |
| ***F04D 13/10*** | (2006.01) |
| ***F04D 13/08*** | (2006.01) |
| ***F04D 29/08*** | (2006.01) |

(52) U.S. Cl.
CPC ..... *E21B 43/128* (2013.01); *F04D 1/066* (2013.01); *F04D 13/06* (2013.01); *F04D 13/08* (2013.01); *F04D 13/086* (2013.01); *F04D 13/10* (2013.01); *F04D 13/16* (2013.01); *F04D 29/043* (2013.01); *F04D 29/086* (2013.01); *F04D 29/426* (2013.01); *F04D 29/445* (2013.01)

(58) Field of Classification Search
CPC ..... F04D 13/06; F04D 29/426; F04D 13/16; F04D 29/445; F04D 29/043; E21B 43/128; E21B 41/0085; E21B 43/126
See application file for complete search history.

(56) References Cited

U.S. PATENT DOCUMENTS

| | | | | |
|---|---|---|---|---|
| 9,494,164 | B2 * | 11/2016 | Baski | F04D 1/066 |
| 2008/0118414 | A1 | 5/2008 | Pagani | |
| 2010/0080686 | A1 | 4/2010 | Teragaki | |

FOREIGN PATENT DOCUMENTS

| | | | |
|---|---|---|---|
| CN | 205654551 | U | 10/2016 |
| DE | 681087 | C | 9/1939 |
| GB | 2242934 | A | 10/1991 |
| JP | S46-018970 | B1 | 5/1971 |
| JP | S59-200089 | A | 11/1984 |
| JP | S63-086393 | U | 6/1988 |
| JP | S64-40713 | A | 2/1989 |
| JP | H01-179191 | U | 12/1989 |
| JP | H07-010076 | Y2 | 3/1995 |
| JP | H07-077191 | A | 3/1995 |
| JP | H08-277798 | A | 10/1996 |
| JP | 2014-025353 | A | 2/2014 |
| JP | 2015-227644 | A | 12/2015 |

OTHER PUBLICATIONS

Office Action dated Dec. 25, 2019, issued in counterpart CN Application No. 201780048406.9, with English translation. (16 pages).
Office Action dated Nov. 17, 2020, issued in counterpart JP application No. 2017-002210, with English Translation. (10 pages).
Office Action dated Aug. 13, 2020, issued in counterpart CN application No. 201780048406.9, with English translation (16 pages).
Office Action dated Aug. 24, 2020, issued in counterpart EP Application No. 17 891 724.1 (6 pages).
International Search Report dated Jan. 16, 2018, issued in counterpart application No. PCT/JP2017/039634, with English translation. (12 pages).
Notification of Transmittal of Translation of the International Preliminary Report on Patentability (Form PCT/IB/338) issued in counterpart International Application No. PCT/JP2017/039634 dated Jul. 25, 2019 with Forms PCT/IB/326, PCT/IB/373 and PCT/ISA/237, with English translation. (17 pages).
Extended (Supplementary) European Search Report dated Jun. 6, 2019, issued in counterpart EP application No. 17891724.1. (8 pages).
Office Action dated Feb. 25, 2020, issued in counterpart EP application No. 17891724.1. (6 pages).

* cited by examiner

LIQUID PRESSURIZING APPARATUS AND UREA SYNTHESIS PLANT

TECHNICAL FIELD

The present disclosure relates to a liquid pressurizing apparatus and a urea synthesis plant.

BACKGROUND ART

A multi-stage centrifugal pump having a multi-stage impellers is used as a liquid pressurizing apparatus for generating high pressure liquid.

For instance, Patent Document 1 discloses a horizontal high pressure pump having a main shaft extending in a horizontal direction and multi-stage impellers arranged in the main shaft. In the high pressure pump described in Patent Document 1, a booster pump is provided on an upstream side of the multi-stage impellers and the booster pump performs fluid pressurization and increases the suction pressure of the high pressure pump.

CITATION LIST

Patent Literature

Patent Document 1: JPH1-179191U

SUMMARY

Problems to be Solved

Meanwhile, in the liquid pressurizing apparatus generating high pressure liquid, cavitation is likely to occur on an impeller on an inlet side if suction pressure is small.

Techniques for suppressing such cavitation are to increase suction pressure of the liquid pressurizing apparatus by using the booster pump described in Patent Document 1, for example, or by increasing water head by providing a tank for liquid supplied to the liquid pressurizing apparatus above the liquid pressurizing apparatus.

However, the techniques cause to increase the number of installation devices for raising suction pressure of the liquid pressurizing apparatus or to increase installation space as the installation position becomes high.

In view of the above, an object of at least one embodiment of the present invention is to provide a liquid pressurizing apparatus capable of suppressing cavitation while reducing installation space.

Solution to the Problems (1) A liquid pressurizing apparatus according to at least one embodiment of the present invention comprises:

a tank provided on a device installation surface for storing liquid so that a fluid level is located above the device installation surface; and a vertical pump including a suction port connected to the tank, multi-stage impellers arranged in a vertical direction, and a discharge port for discharging the liquid passing through the multi-stage impellers.

The multi-stage impellers include a first stage impeller positioned at the lowest part of the multi-stage impellers and being configured such that the liquid from the suction port flows into the first stage impeller.

The first stage impeller is disposed below the device installation surface.

With the above configuration (1), the use of the multi-stage vertical pump can reduce the installation space of the apparatus. Further while securing high discharge pressure by increasing the number of stages of the impellers, it is possible to reduce the number of revolutions of the pump. Thus, it is possible to suppress cavitation in the first stage impeller by reducing the number of revolutions of the pump. Further, the vertical pump is arranged so that the first stage impeller is disposed below the device installation surface, thus it is possible to suppress cavitation in the first stage impeller while reducing the height of the tank and sufficiently secure a head difference between the tank and the vertical pump.

In this way, according to the above configuration (1), since cavitation in the first stage impeller can be suppressed, it is not necessary to provide a booster pump between the tank and the vertical pump, which achieves reduction in facility cost and space saving.

(2) In some embodiments, in the above configuration (1), The vertical pump includes:

an outer casing at least partially accommodated in a recessed part formed by digging down from the device installation surface;

an intermediate casing provided inside the outer casing so as to cover the multi-stage impellers; and a casing cover attached to the outer casing so as to seal an upper end opening of the outer casing and having a first inner flow channel communicating with the suction port and a second inner flow channel communicating with the discharge port.

A flow passage for the liquid flowing from the suction port and the first inner flow channel toward the first stage impeller positioned at the lowest part is formed between the outer casing and the intermediate casing.

With the above configuration (2), it is possible to introduce the liquid to the first stage impeller positioned sufficiently below the device installation surface while suppressing height of the whole liquid pressurizing apparatus from the device installation surface by accommodating a part of the vertical pump in the recessed part formed at the device installation surface. Accordingly, it is possible to effectively suppress cavitation in the first stage impeller while reducing the height of the tank and sufficiently secure a head difference between the tank and the vertical pump.

(3) In some embodiments, in the above configuration (1) or (2), the configuration further comprises:

a first motor having an output shaft extending along a horizontal direction and being configured to drive the vertical pump; and a bevel gear positioned above the vertical pump and provided between the output shaft of the first motor and a rotary shaft of the vertical pump.

The first motor is positioned on a side of the vertical pump without overlapping with the vertical pump in a plan view.

With the above configuration (3), the vertical pump and the first motor don't overlap each other in the plain view. Maintenance for the vertical pump is performed easily by removing only the bevel gear while the first motor is attached.

(4) In some embodiments, in the above configuration (1) or (2), the configuration further comprises a second motor having an output shaft extending along a vertical direction and being configured to drive the vertical pump.

The output shaft of the second motor is directly connected to the rotary shaft of the vertical pump.

As describe in the above (1), with at least some liquid pressurizing apparatus, it is possible to reduce the number of revolutions of the pump while securing high discharge pressure by increasing the number of stages of the impellers. Thus, with the above configuration (4), the output shaft of the second motor is directly connected to the rotary shaft of the vertical pump, then a speed increasing unit can be omitted. Accordingly, a lubricating oil unit for circulating lubricating oil supplied to the speed increasing unit becomes unnecessary, which enables to further reduce the size and facility cost of the liquid pressurizing apparatus.

(5) In some embodiments, in any one of the above configurations (1) to (4),

The vertical pump includes:

a casing accommodating the multi-stage impellers;

a rotary shaft configured to rotate with the multi-stage impellers; and a tandem mechanical seal provided in a penetration part of the casing for the rotary shaft.

The tandem mechanical seal includes:

a pair of stationary rings provided in the casing;

a pair of rotary rings configured to be rotatable with the rotary shaft so as to slide with respect to the respective stationary rings; and a pumping ring provided on one of the pair of rotary rings that is located between the pair of stationary rings.

With the above configuration (5), the tandem mechanical seal uses a lower pressure buffer fluid than a double mechanical seal which uses a higher pressure barrier fluid than the process fluid, which is capable of sealing the process fluid in the vertical pump. Further, with the above configuration (5), the pumping ring can circulate the buffer fluid, then an auxiliary machine for circulating the buffer fluid is not necessary. Accordingly, it is possible to simplify the auxiliary machine for pressurizing and circulating the barrier fluid supplied to a shaft seal device and simplify the configuration of the liquid pressurizing apparatus as compared with a case where the double mechanical seal is adopted.

(6) In some embodiments, in any one of the above configurations (1) to (5), the discharge pressure of the vertical pump is 10 MPa or more.

Generally, a horizontal pump rotating at a high speed, for example, of 6000 rpm or more is used to obtain a high discharge pressure of 10 MPa or more. However, when using the horizontal pump with a high rotation speed, cavitation in the first stage impeller of the horizontal pump may be a problem. It is possible to provide a booster pump, for example, between a tank and the horizontal pump to suppress the cavitation. In this case, it may be a problem that equipment installation space enlarges accompanying installation of the booster pump and facility cost increases.

With the above configuration (6), even if the discharge pressure of the vertical pump is at a high pressure of 10 MPa or more, as described in the above (1), it is possible to suppress cavitation in the first stage impeller by locating the multi-stage impellers such that the first stage impeller positions below the device installation surface. Accordingly, it is not necessary to provide a booster pump between the tank and the vertical pump, which achieves reduction in facility cost and space saving.

(7) In some embodiments, in any one of the above configurations (1) to (6), the multi-stage impellers include impellers in ten or more stages.

With the above configuration (7), the impellers in ten or more stages are used, thus it is possible to ensure a sufficient discharge pressure even if the number of revolutions of the vertical pump is lowered. Thus, it is possible to effectively suppress cavitation in the first stage impeller by reducing the number of revolutions of the vertical pump.

(8) In some embodiments, in any one of the above configurations (1) to (7),

The vertical pump is an ammonia pump for pressurizing a raw material ammonia in a urea synthesis plant or a carbamate pump for pressurizing a carbamate that is intermediate in the urea synthesis plant.

The ammonia pump and the carbamate pump in the urea synthesis plant raise the ammonia or the carbamate to a high pressure of, for example, 10 MPa or more and is used to supply the urea to a reactor for generating urea.

In this regard, with the above configuration (8), the use of the multi-stage vertical pump as the ammonia pump or the carbamate pump in the urea synthesis plant can reduce the installation space of the apparatus. Further while securing high discharge pressure by increasing the number of stages of the impellers, it is possible to reduce the number of revolutions of the pump. Thus, it is possible to suppress cavitation in the first stage impeller by reducing the number of revolutions of the pump. Further, the vertical pump is arranged so that the first stage impeller is positioned below the device installation surface, thus it is possible to suppress cavitation in the first stage impeller while reducing the height of the tank and sufficiently secure a head difference between the tank and the vertical pump.

In this way, according to the above configuration (8), since cavitation in the first stage impeller can be suppressed, it is not necessary to provide a booster pump between the tank and the vertical pump, which achieves reduction in facility cost and space saving.

(9) A urea synthesis plant according to at least one embodiment of the present invention comprises:

an ammonia pump for pressurizing a raw material ammonia;

a carbamate pump for pressurizing a carbamate that is intermediate; and a reactor to which the ammonia pressurized by the ammonia pump, the carbamate pressurized by the carbamate pump, and carbon dioxide are supplied.

At least one of the ammonia pump or the carbamate pump is the vertical pump of the liquid pressurizing apparatus according to any one of the above (1) to (8).

With the above configuration (9), the use of the multi-stage vertical pump as the ammonia pump or the carbamate pump in the urea synthesis plant can reduce the installation space of the apparatus. Further while securing high discharge pressure by increasing the number of stages of the impellers, it is possible to reduce the number of revolutions of the pump. Thus, it is possible to suppress cavitation in the first stage impeller by reducing the number of revolutions of the pump. Further, the vertical pump is arranged so that the first stage impeller is positioned below the device installation surface, thus it is possible to suppress cavitation in the first stage impeller while reducing the height of the tank and sufficiently secure a head difference between the tank and the vertical pump.

In this way, according to the above configuration (9), since cavitation in the first stage impeller can be suppressed, it is not necessary to provide a booster pump between the tank and the vertical pump, which achieves reduction in facility cost and space saving.

Advantageous Effects

According to at least one embodiment of the present invention, the liquid pressurizing apparatus capable of suppressing cavitation while reducing the installation space is provided.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
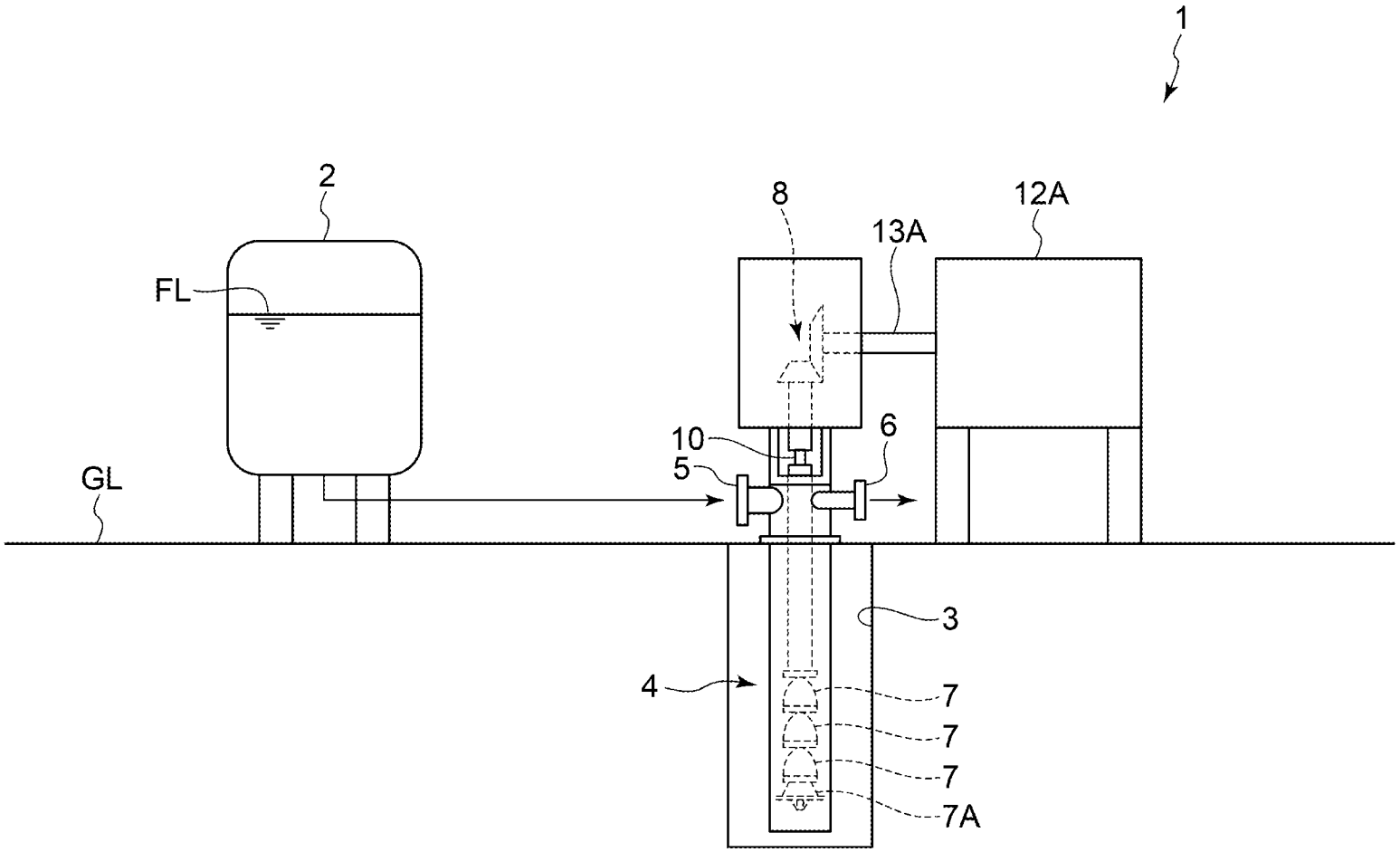
FIG. 1 is a schematic configuration diagram of a liquid pressurizing apparatus according to an embodiment.
Figure 2:
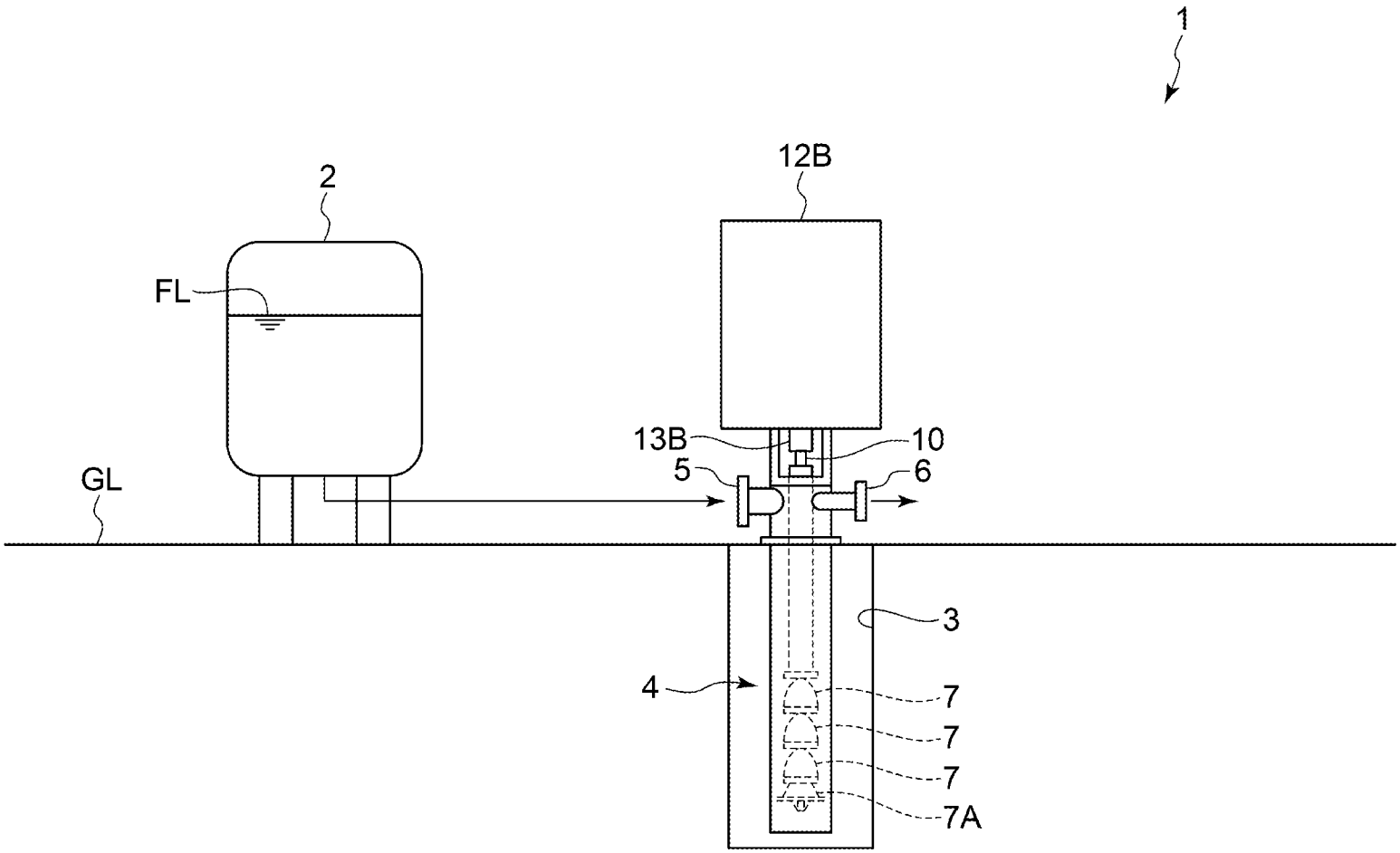
FIG. 2 is a schematic configuration diagram of a liquid pressurizing apparatus according to an embodiment.

FIGS. 1 and 2 are respectively schematic configuration diagrams of a liquid pressurizing apparatus according to an embodiment. As shown in FIGS. 1 and 2, a liquid pressurizing apparatus 1 according to some embodiments includes a tank 2 for storing liquid to be pressurized, a vertical pump 4 for pressurizing the liquid supplied from the tank 2, a motor 12A or 12B for driving the vertical pump 4.

The tank 2 is installed on a device installation surface GL and a fluid level FL in the tank 2 is positioned above the device installation surface GL.

As shown in FIGS. 1 and 2, at least a part of the vertical pump 4 is housed in a recessed part 3 formed by digging down from the device installation surface GL. In an illustrative embodiment depicted in FIGS. 1 and 2, a lower part of the vertical pump 4 is housed in the recessed part 3.

The vertical pump 4 includes a suction port 5 connected to the tank 2, multi-stage impellers 7 arranged in a vertical direction, a discharge port 6 for discharging the liquid passing through the multi-stage impellers 7. An impeller 7 positioned at the lowest position among the multi-stage impellers 7 is a first stage impeller 7A. The first stage impeller 7A positions below the device installation surface GL to which the tank 2 is installed.

Further, the vertical pump 4 has a rotary shaft 10 extending along the vertical direction. The rotary shaft 10 is connected to an output shaft 13A of the motor 12A or an output shaft 13B of the motor 12B, thus the multi-stage impellers 7 is configured to rotate with the rotary shaft 10 by being driven by the motor 12A or the motor 12B.

The vertical pump 4 is configured such that the liquid from the tank 2 is supplied through the suction port 5. The liquid supplied from the suction port 5 flows into the first stage impeller 7A, passes through the first stage impeller 7A and flows sequentially to downstream side impellers 7. The liquid is pressurized by receiving rotational energy of the impellers 7 when passing through the multi-stage impellers 7. The high-pressure liquid passing through the final stage impeller 7 provided on the most downstream side of the multi-stage impellers 7 is discharged from the vertical pump 4 through the discharge port 6.

In the liquid pressurizing apparatus 1, the use of the multi-stage vertical pump 4 described above can reduce the installation space of the apparatus as compared with the use of a horizontal type multi-stage pump in which the plurality of stages of the impellers are arranged in the horizontal direction. Further while securing high discharge pressure by increasing the number of stages of the impellers 7, it is possible to reduce the number of revolutions of the pump. Thus, it is possible to suppress cavitation in the first stage impeller 7A by reducing the number of revolutions of the pump. Further, the vertical pump 4 is arranged so that the first stage impeller 7A is positioned below the device installation surface GL, thus it is possible to suppress cavitation in the first stage impeller 7A while reducing the height of the installation position of the tank 2 and sufficiently secure a head difference between the tank 2 and the vertical pump 4.

Thus, since cavitation in the first stage impeller 7A can be suppressed by using the vertical pump 4, it is not necessary to provide a booster pump between the tank 2 and the pump (vertical pump 4) or it is not necessary to set the tank 2 at high installation position. Accordingly, it is possible to achieve reduction in facility cost and space saving in the liquid pressurizing apparatus 1.

In an illustrative embodiment depicted in FIG. 1, the output shaft 13A of the motor 12A (first motor) for driving the vertical pump 4 extends along the horizontal direction. A bevel gear 8 is provided over the vertical pump 4 for transmitting power between the output shaft 13A of the motor 12A and the rotary shaft 10 of the vertical pump 4. Further, the motor 12A is positioned on the side of vertical pump 4 without overlapping with the vertical pump 4 in the plan view.

In this way, the vertical pump 4 and the motor 12A don't overlap each other in the plain view. Maintenance for the vertical pump 4 is performed easily by removing only the bevel gear 8 while the motor 12A is attached.

In the illustrative embodiment shown in FIG. 2, the output shaft 13B of the motor 12B (second motor) for driving the vertical pump 4 extends along the vertical direction and the output shaft 13B directly connects to the rotary shaft 10 of the vertical pump 4.

As described the above, the vertical pump 4 is capable of reducing the number of revolutions of the pump, while securing high discharge pressure by increasing the number of stages of the impellers. It is unnecessary to provide a speed increasing unit between the output shaft 13B of the motor 12B and the rotary shaft 10 of the vertical pump 4. Further, both of the output shaft 13B of the motor 12B and the rotary shaft 10 of the vertical pump 4 extend along the vertical direction. It is unnecessary to provide a mechanism (e.g. Bevel gear) for converting power transmission direction between the output shaft 13B and the rotary shaft 10. Then, in the embodiment depicted in FIG. 2, it is possible to configure such that the output shaft 13B and the rotary shaft 10 are directly connected. Accordingly, a lubricating oil unit for circulating lubricating oil supplied to such a speed increasing unit becomes unnecessary, which enables to further reduce the size and facility cost of the liquid pressurizing apparatus 1.

Figure 3:
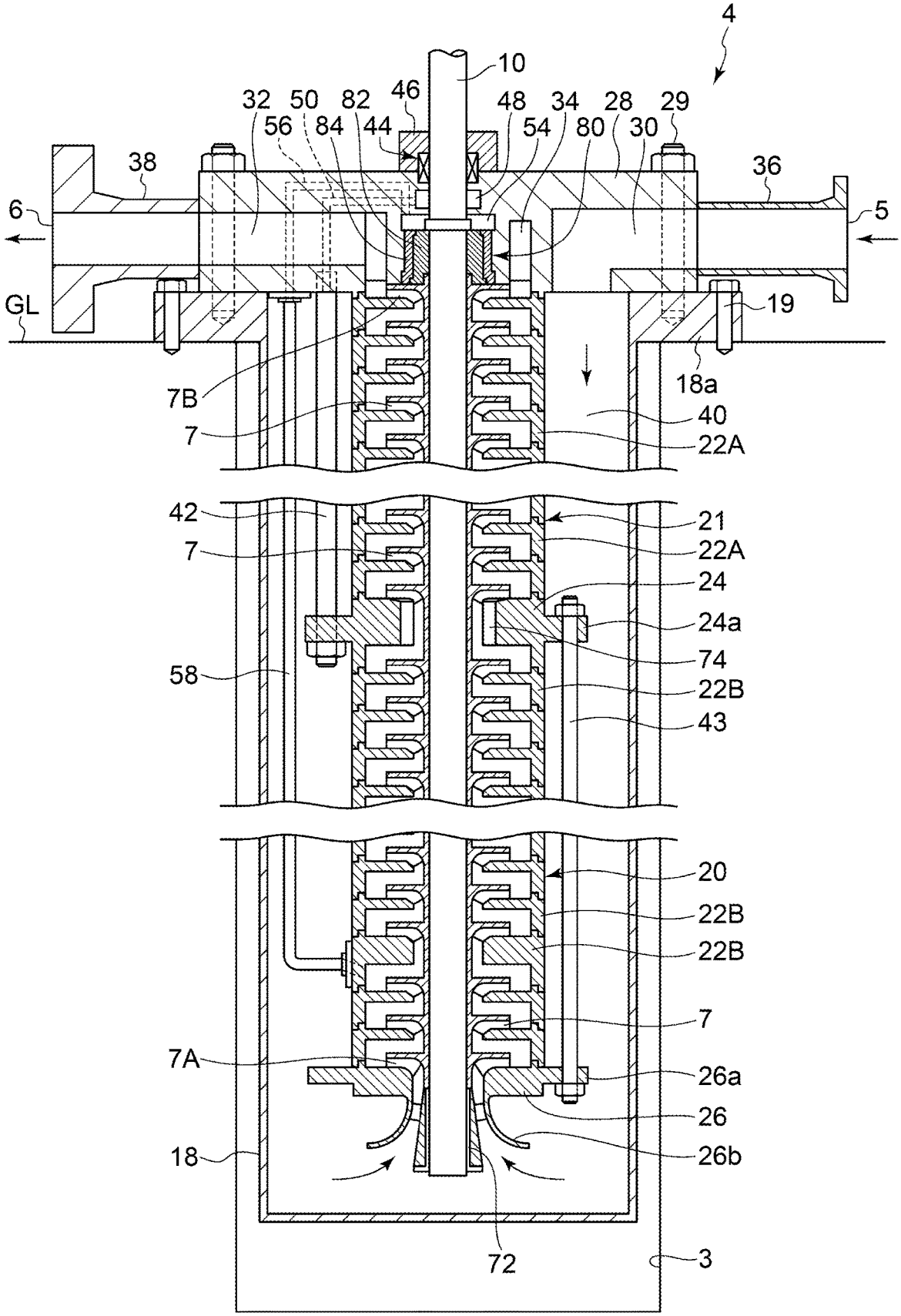
FIG. 3 is a schematic configuration diagram of a vertical pump according to an embodiment.

FIG. 3 is a schematic configuration diagram of a vertical pump 4 according to an embodiment. An arrow in FIG. 3 represents a direction of a flow of liquid pressurized by the vertical pump 4.

As shown in FIG. 3, the vertical pump 4 includes the multi-stage impellers 7 described above, and a casing including an outer casing 18, an intermediate casing 20 and a casing cover 28. The multi-stage impellers 7 is accommodated in the casing. The intermediate casing 20 is provided inside the outer casing 18 so as to cover the multi-stage impellers 7. The casing cover 28 is attached to the outer casing 18 so as to seal an upper end opening of the outer casing 18. Further, the rotary shaft 10 rotating with the multi-stage impellers 7 is rotatably supported by the intermediate casing 20 by way of bearings 72, 74.

The outer casing 18 includes a flange part 18*a* provided on an upper end part so as to protrude outward in a radial direction of the rotary shaft 10 (hereinafter, referred to as simply "radial direction"), and is fixed to the device installation surface GL by a plurality of bolts 29 passing through bolt holes provided in the flange part 18*a*. A portion of the outer casing 18 below the flange part 18*a* is housed in a recessed part 3 formed by digging down from the device installation surface GL.

The casing cover 28 is fixed to the outer casing 18 by bolts 29 arranged in a circumferential direction of the rotary shaft 10. A first internal flow passage 30 communicating with the suction port 5 and a second internal flow passage 32 communicating with the discharge port 6 are formed in the casing cover 28. Further, the second internal flow passage 32 includes an annular flow passage 34 communicating with an outlet of the final stage impeller 7B closest to the casing cover 28 among the multi-stage impellers 7.

A flow passage 40 for liquid flowing from the first internal flow passage 30 formed in the suction port 5 and the casing cover 28 toward the first stage impeller 7A positioned at the lowest part of the multi-stage impellers 7, is formed between the outer casing 18 and the intermediate casing 20.

The liquid flowing toward the first stage impeller 7A through the flow passage 40 is led to a suction bell 26*b* (described below) located at the lowest part of the intermediate casing 20, and the liquid flows into the first stage impeller 7A.

Further, the liquid passing through the multi-stage impeller 7 and flowing out from an outlet port of the final stage impeller 7B is discharged from the discharge port 6 to an outside of the vertical pump 4 through the second internal flow passage 32 including the annular flow passage 34.

As shown in FIG. 3, the suction port 5 may be provided at a suction nozzle 36 attached at the casing cover 28, and the suction port 5 and the first internal flow passage 30 may be communicated by way of a through hole penetrating through the suction nozzle 36. Further, as shown in FIG. 3, the suction port 6 may be provided at a discharge nozzle 38 attached at the casing cover 28, and the suction port 6 and the second internal flow passage 32 may be communicated by way of a through hole penetrating through the discharge nozzle 38. The suction nozzle 36 and the discharge nozzle 38 may be attached to the casing cover 28 by welding.

The intermediate casing 20 includes a plurality of sections (22A, 22B, 24, 26) stacked in an axial direction of the rotary shaft 10 (hereinafter, referred to as simply "axial direction") and a plurality of tie bolts (42, 44) for fastening the plurality of sections (22A, 22B, 24, 26).

In the illustrative embodiment depicted in FIG. 3, the plurality of sections constituting of the intermediate casing 20 include a fastening section 24 fixed with one ends of tie bolts (42, 44), a suction bell section 26, a plurality of first sections 22A and second sections 22B which are stacked in the axial direction.

The fastening section 24 is located on an opposite side of the casing cover 28 across the plurality of first sections 22A in the axial direction. Each one end of the tie bolts 42 is fixed to the fastening section 24 while each other end of the tie bolts 42 is fixed to the casing cover 28. The plurality of first sections 22A are arranged between the casing cover 28 and the fastening section 24.

The suction bell section 26 is located on a side opposite to the casing cover 28 across the multi-stage impellers 7 in the axial direction and has the suction bell 26*b* for introducing liquid to the first stage impeller 7A of the multi-stage impellers 7. Each one end of the tie bolts 43 is fixed to the fastening section 24 while each other end of the tie bolts 43 is fixed to the suction bell section 26. The plurality of second sections 22B are arranged between the fastening section 24 and the suction bell section 26.

The fastening section 24 has a flange part 24*a* provided so as to protrude outward in the radial direction. The flange part 24*a* is provided with a plurality of bolt holes into which the plurality of tie bolts 42 and the plurality of tie bolts 43 are screwed.

Further, the suction bell section 26 has a flange part 26*a* provided so as to protrude outward in the radial direction. The flange part 26*a* is provided with a plurality of bolt holes into which the plurality of tie bolts 43 are screwed.

Each lower end part of the sections (22A, 22B, 24) and an upper end part of an adjacent section (22A, 22B, 24, 26) to the corresponding one of the sections may have a socket-and-spigot structure 21.

In an illustrative embodiment shown in FIG. 3, the socket-and-spigot structure is formed by a convex part provided so as to project downward at an outer peripheral side edge part of each lower end part of the sections (22A, 22B, 24) and a recess part provided on the upper end part of the adjacent section to the corresponding one of the sections so as to correspond to the convex part described above.

Thus, each positioning of the sections (22A, 22B, 24, 26) in the radial direction is facilitated by forming the socket-and-spigot structure between the plurality of adjacent sections, In some embodiments, the discharge pressure of the vertical pump 4 is 10 MPa or more.

The liquid pressurizing apparatus 1 (see FIGS. 1 and 2) uses the vertical pump 4 described above. Even if the discharge pressure of the pump is at a high pressure of 10 MPa or more, it is possible to suppress cavitation in the first stage impeller 7A by locating the multi-stage vertical pump 4 such that the first stage impeller 7A positions below the device installation surface GL. Accordingly, it is not necessary to provide a booster pump between the tank 2 and the vertical pump 4, which achieves reduction in facility cost and space saving.

In some embodiments, the multi-stage impellers 7 include impellers 7 in ten or more stages.

In the liquid pressurizing apparatus 1 (see FIGS. 1 and 2), the vertical pump 4 having the impellers 7 in ten or more stages are used, thus it is possible to ensure a sufficient discharge pressure even if the number of revolutions of the vertical pump 4 is lowered. Thus, it is possible to effectively suppress cavitation in the first stage impeller 7A by reducing the number of revolutions of the vertical pump 4.

In some embodiments, as shown in FIG. 3, a thrust balancing part 80 for balancing thrust force acting on the rotary shaft 10 is provided in the through hole, which the rotary shaft 10 penetrates, of the casing cover 28. The thrust force acting on the rotary shaft 10 is a force in a direction from a high pressure side to a low pressure side of the multi-stage impellers 7 in the axial direction, that is, a force in a direction from the final stage impeller 7B to the first stage impeller 7A.

The thrust balancing part 80 includes a balance sleeve 82 attached to an outer periphery of the rotary shaft 10 and being configured to rotate with the rotary shaft 10 and a balance bushing 84 provided on the casing cover 28 on an outer peripheral side of the balance sleeve 82.

Further, an intermediate chamber 54 is formed on the opposite side of the multi-stage impellers 7 across the thrust balancing part 80 in the axial direction between the casing cover 28 and the rotary shaft 10. The pressure of the intermediate chamber 54 acts on an upper end surface of the balance sleeve 82.

The intermediate chamber 54 communicates with an intermediate stage impeller through a balance internal flow passage 56 formed in the casing cover 28 and a balance pipe 58 provided between the intermediate casing 20 and the outer casing 18. In the present specification, the "intermediate stage impeller" refers to an arbitrary impeller on the downstream side of the first stage impeller 7A and on the upstream side of the final stage impeller 7B.

That is, a pressure $P_M$ of the intermediate stage impeller is introduced into the intermediate chamber 54 and the pressure $P_M$ of the intermediate stage impeller acts on the upper end surface of the balance sleeve 82.

In this way, the pressure $P_M$ of the intermediate stage impeller acts on the balance sleeve 82 and it is possible to act a reverse thrust force (force opposite to thrust force described above in axial direction), which is caused by a differential pressure between the pressure (discharge pressure $P_D$ ($>P_M$)) of liquid passing through the final stage impeller 7B and the pressure $P_M$ of the intermediate stage impeller, on the balance sleeve 82. Accordingly, it is possible to achieve balancing of the thrust force of the vertical pump 4.

In some embodiments, as shown in FIG. 3, a tandem mechanical seal 44 is provided in the through hole of the rotary shaft 10 of the casing as a shaft sealing device for preventing liquid inside the vertical pump 4 from leaking to the outside.

In the illustrative embodiment depicted in FIG. 3, in the casing having the casing cover 28 and a seal housing part 46 fixed to the casing cover 28, the through hole is provided such that the rotary shaft 10 penetrates the casing cover 28 and the seal housing part 46.

Figure 4:
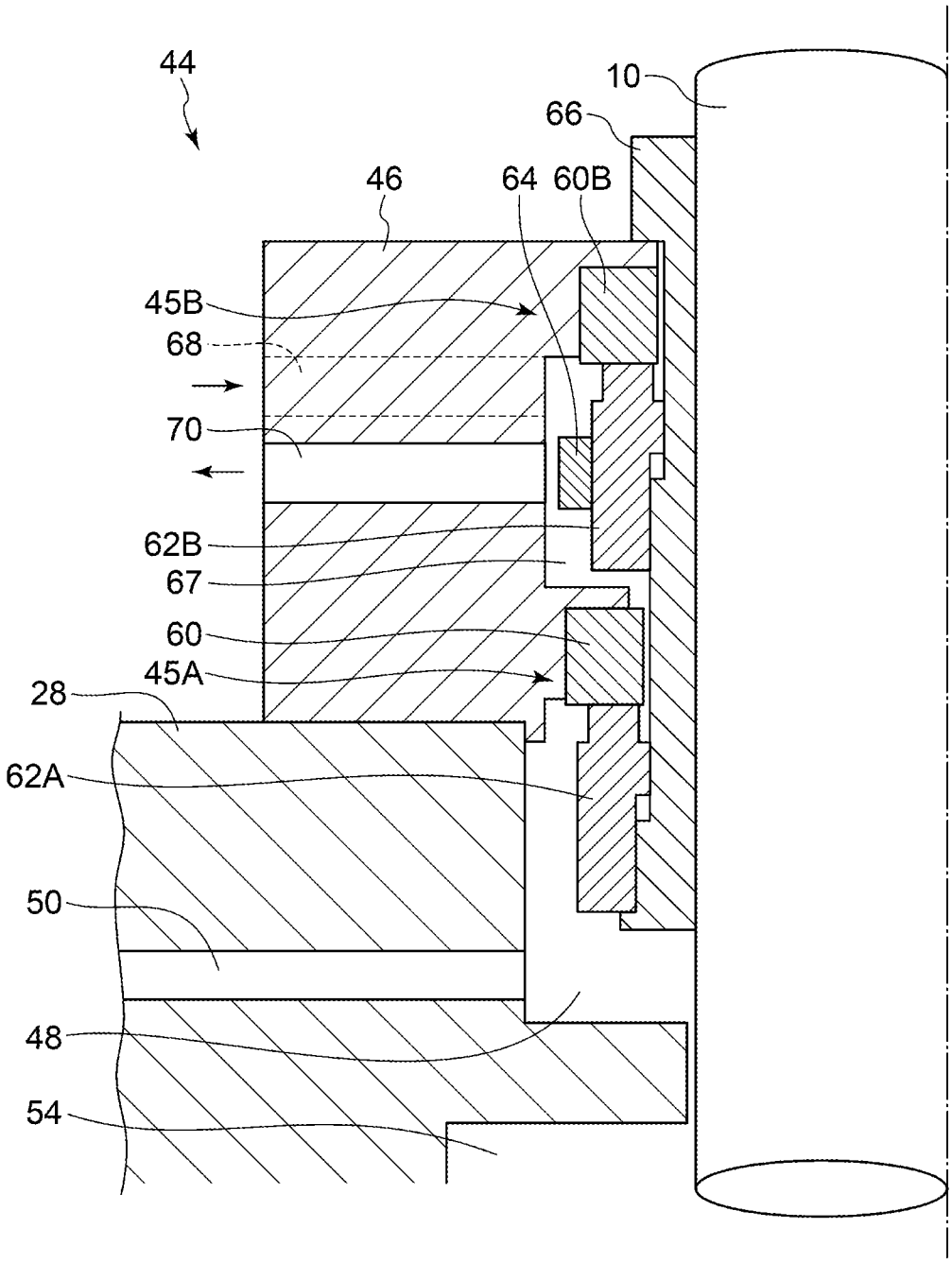
FIG. 4 is a schematic configuration diagram of a tandem mechanical seal according to an embodiment.

FIG. 4 is a schematic configuration diagram of the tandem mechanical seal according to an embodiment. The tandem mechanical seal 44 depicted in FIG. 4 includes a pair of stationary rings 60A, 60B attached to the seal housing part 46 (casing) and a pair of rotary rings 62A, 62B configured to be rotatable with the rotary shaft 10. The rotary rings 62A, 62B are attached to the outer periphery of the rotary shaft 10 and are fixed to an outer peripheral surface of a shaft sleeve 66 configured to rotate with the rotary shaft 10.

The stationary ring 60A of the pair of stationary rings 60A, 60B and the rotary ring 62A of the pair of rotary rings 62A, 62B which are arranged on a side closer to the multi-stage impellers 7 in the axial direction, constitute a high-pressure seal 45A, while the stationary ring 60B and the rotary ring 62B which are arranged on a side farther from the multi-stage impellers 7 in the axial direction constitute a low-pressure seal 45B.

The pair of rotary rings 62A, 62B are configured to slide with respect to the pair of stationary rings 60A, 60B with rotation of the rotary shaft 10, respectively. The fluid leakage is suppressed by contacting sliding surfaces of the pair of stationary rings 60A, 60B and the pair of rotary rings 62A, 62B each other.

A low pressure chamber 48 is provided adjacent to the tandem mechanical seal 44 in the axial direction between the rotary shaft 10 and the casing cover 28 (casing). The low pressure chamber 48 communicates with the flow passage 40 formed between the outer casing 18 and the intermediate casing 20 by way of a flushing inlet flow passage 50 formed in the casing cover 28. That is, liquid in low pressure, which flows into the vertical pump 4 from the suction port 5, before being pressurized by the multi-stage impellers 7 is introduced to the low pressure chamber 48 through the flushing inlet flow passage 50.

Further, in between the rotary shaft 10 and a seal housing part 46 (casing), a seal chamber 67 to which the outside fluid (buffer fluid) is supplied is provided between the pair of stationary rings 60A, 60B in the axial direction. Further, a buffer inlet flow passage 68 and a buffer outlet flow passage 70 are provided in the seal housing part 46. The buffer inlet flow passage 68 and the buffer outlet flow passage 70 are connected to an external fluid tank (not shown) provided outside the vertical pump 4. The outside fluid stored in the external fluid tank is introduced into the seal chamber 67 through the buffer inlet flow passage 68, is discharged from the seal chamber 67 via the buffer outlet flow passage 70, and is returned to the external fluid tank.

A pumping ring 64 is provided on the rotary ring 62B of the pair of rotary rings 62A, 62B, which positions between the pair of stationary rings 60A, 60B, that is, one rotary ring provided in the seal chamber 67. The tandem mechanical seal 44 is configured so that the outside fluid is sent from the seal chamber 67 to the external fluid tank through the buffer outlet flow passage 70 by the pumping ring 64.

The tandem mechanical seal 44 described above is used as a shaft sealing device, which is capable of sealing process fluid in the vertical pump by using the external fluid (buffer fluid) being in lower pressure than the double mechanical seal.

Further, the pumping ring 64 can circulate the buffer fluid by using the tandem mechanical seal 44 described above, then an auxiliary machine for circulating the buffer fluid is not necessary. Accordingly, it is possible to simplify the auxiliary machine for pressurizing and circulating the barrier fluid supplied to the shaft seal device and simplify the configuration of the liquid pressurizing apparatus (see FIGS. 1 and 2) as compared with a case where the double mechanical seal is adopted.

A urea synthesis plant (not shown) according to some embodiments may include the liquid pressurizing apparatus 1 including the vertical pump 4 described above.

The urea synthesis plant according to some embodiments includes an ammonia pump for pressurizing a raw material ammonia, a carbamate pump for pressurizing a carbamate and a reactor to which the ammonia pressurized by the ammonia pump, the carbamate pressurized by the carbamate pump, and carbon dioxide are supplied. At least one of the ammonia pump or the carbamate pump is the vertical pump 4 of the liquid pressurizing apparatus according to some above-described embodiments.

For instance, if the ammonia pump is the vertical pump 4, the liquid to be pressurized is liquid ammonia of a raw material of urea and the liquid ammonia stored in the tank 2 is supplied to the vertical pump 4 through the suction port 5.

Further, for instance, if the carbamate pump is the vertical pump 4, the liquid to be pressurized is an intermediate carbamate (carbamate ammonium) generated by reaction of the ammonia and the carbon dioxide and the liquid carbamate stored in the tank 2 is supplied to the vertical pump 4 through the suction port 5.

In the urea synthesis plant described above, the carbamate is generated from ammonia and carbon dioxide under high temperature and high pressure in the reactor to which pressurized ammonia, carbamate and carbon dioxide are supplied. Accordingly, the generated carbamate and a part of the carbamate supplied from the carbamate pump are decomposed into urea and water by a dehydration reaction. Then, the remaining carbamate is sent, for example, to a decomposition tower, heated and decomposed into urea and water by a dehydration reaction. The urea generated by the reactions is separated and recovered as a product. The unreacted remaining carbamate is also separated, recovered, pressurized by the carbamate pump, supplied to the reactor and used in the production of urea.

In this way, the use of the above-described vertical pump 4 as the ammonia pump or the carbamate pump in the urea synthesis plant can reduce the installation space of the apparatus. Further while securing high discharge pressure by increasing the number of stages of the impellers, it is possible to reduce the number of revolutions of the pump. Thus, it is possible to suppress cavitation in the first stage impeller 7A by reducing the number of revolutions of the pump. Further, the vertical pump 4 is arranged so that the first stage impeller 7A is positioned below the device installation surface GL, thus it is possible to suppress cavitation in the first stage impeller 7A while reducing the height of the tank 2 and sufficiently secure a head difference between the tank 2 and the vertical pump 4.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

DESCRIPTION OF REFERENCE NUMERALS

1 Liquid pressurizing apparatus
2 Tank
3 Recessed part
4 Vertical pump
5 Suction port
6 Discharge port
7 Impeller
7A First stage impeller
7B Final stage impeller
8 Bevel gear
10 Rotary shaft
12A,12B Motor
13A,13B Output shaft
18 Outer casing
18*a* Flange part
20 Intermediate casing
21 Socket-and-spigot structure
22A First section
22B Second section
24 Fastening section
24*a* Flange part
26 Suction bell section
26*a* Flange part
26*b* Suction bell
28 Casing cover
29 Bolt
30 First internal flow passage
32 Second internal flow passage
34 Annular flow passage
36 Suction nozzle
38 Discharge nozzle
40 Flow passage
42 Tie bolt
43 Tie bolt
44 Tandem mechanical seal
45A High-pressure seal
45B Low-pressure seal
46 Seal housing part
48 Low pressure chamber
50 Flushing inlet flow passage
54 Intermediate chamber
56 Balance internal flow passage
56 Balance pipe
60A,60B Stationary ring
62A,62B Rotary ring
64 Pumping ring
66 Shaft sleeve
67 Seal chamber
68 Buffer inlet flow passage
70 Buffer outlet flow passage
72 Bearing
74 Bearing
80 Thrust balancing part
82 Balance sleeve
84 Balance bushing
FL Fluid level
GL Device installation surface

The invention claimed is:

1. A liquid pressurizing apparatus, comprising:

a tank provided on a device installation surface for storing liquid so that a fluid level is located above the device installation surface; and a vertical pump including a suction port connected to the tank, multi-stage impellers arranged in a vertical direction, and a discharge port for discharging the liquid passing through the multi-stage impellers, wherein the multi-stage impellers include a first stage impeller positioned at a lowest part of the multi-stage impellers and being configured such that the liquid from the suction port flows into the first stage impeller, wherein the first stage impeller is disposed below the device installation surface, and wherein the vertical pump is configured to be supplied with the liquid from the tank through the suction port.

2. The liquid pressurizing apparatus according to claim 1, further comprising:

a first motor having an output shaft extending along a horizontal direction and being configured to drive the vertical pump; and a bevel gear positioned above the vertical pump and provided between the output shaft of the first motor and a rotary shaft of the vertical pump, wherein the first motor is positioned on a side of the vertical pump without overlapping with the vertical pump in a plan view.

3. The liquid pressurizing apparatus according to claim 1, further comprising a second motor having an output shaft extending along a vertical direction and being configured to drive the vertical pump, wherein the output shaft of the second motor is directly connected to a rotary shaft of the vertical pump.

4. The liquid pressurizing apparatus according to claim 1, wherein the discharge pressure of the vertical pump is 10 MPa or more.

5. The liquid pressurizing apparatus according to claim 1, wherein the multi-stage impellers include impellers in ten or more stages.

6. The liquid pressurizing apparatus according to claim 1, wherein the vertical pump is an ammonia pump for pressurizing a raw material ammonia in a urea synthesis plant or a carbamate pump for pressurizing a carbamate that is intermediate in the urea synthesis plant.

7. A urea synthesis plant, comprising:

an ammonia pump for pressurizing a raw material ammonia;

a carbamate pump for pressurizing a carbamate that is intermediate; and a reactor to which the ammonia pressurized by the ammonia pump, the carbamate pressurized by the carbamate pump, and carbon dioxide are supplied, wherein at least one of the ammonia pump or the carbamate pump is the vertical pump of the liquid pressurizing apparatus according to claim 1.

8. The liquid pressurizing apparatus according to claim 1, wherein the suction port is disposed above the device installation surface.

9. A liquid pressurizing apparatus, comprising:

a tank provided on a device installation surface for storing liquid so that a fluid level is located above the device installation surface; and a vertical pump including a suction port connected to the tank, multi-stage impellers arranged in a vertical direction, and a discharge port for discharging the liquid passing through the multi-stage impellers, wherein the multi-stage impellers include a first stage impeller positioned at a lowest part of the multi-stage impellers and being configured such that the liquid from the suction port flows into the first stage impeller, wherein the first stage impeller is disposed below the device installation surface, wherein the vertical pump includes:

an outer casing at least partially accommodated in a recessed part formed by digging down from the device installation surface;

an intermediate casing provided inside the outer casing so as to cover the multi-stage impellers; and a casing cover attached to the outer casing so as to seal an upper end opening of the outer casing, the casing cover having a first inner flow channel communicating with the suction port and a second inner flow channel communicating with the discharge port, and wherein a flow passage for the liquid flowing from the suction port and the first inner flow channel toward the first stage impeller positioned at the lowest part is formed between the outer casing and the intermediate casing.

10. A liquid pressurizing apparatus, comprising:

a tank provided on a device installation surface for storing liquid so that a fluid level is located above the device installation surface; and a vertical pump including a suction port connected to the tank, multi-stage impellers arranged in a vertical direction, and a discharge port for discharging the liquid passing through the multi-stage impellers, wherein the multi-stage impellers include a first stage impeller positioned at a lowest part of the multi-stage impellers and being configured such that the liquid from the suction port flows into the first stage impeller, wherein the first stage impeller is disposed below the device installation surface, wherein the vertical pump includes:

a casing accommodating the multi-stage impellers;

a rotary shaft configured to rotate with the multi-stage impellers; and a tandem mechanical seal provided in a penetration part of the casing for the rotary shaft, and wherein the tandem mechanical seal includes:

a pair of stationary rings provided in the casing;

a pair of rotary rings configured to be rotatable with the rotary shaft so as to slide with respect to the respective stationary rings; and a pumping ring provided on one of the pair of rotary rings that is located between the pair of stationary rings.

* * * * *